US006912754B2

(12) United States Patent
Kunkle et al.

(10) Patent No.: US 6,912,754 B2
(45) Date of Patent: Jul. 5, 2005

(54) GOLF SHOE BRUSH

(76) Inventors: Gerald D. Kunkle, 545 Circle Lake Rd., Wichita, KS (US) 67209; James C. Bulloch, 10505 W. 33rd St., Wichita, KS (US) 67205

( * ) Notice: Subject to any disclaimer, the term of this patent is extended or adjusted under 35 U.S.C. 154(b) by 238 days.

(21) Appl. No.: 10/404,032

(22) Filed: Apr. 2, 2003

(65) Prior Publication Data

US 2003/0233720 A1 Dec. 25, 2003

Related U.S. Application Data

(60) Provisional application No. 60/390,959, filed on Jun. 24, 2002.

(51) Int. Cl.[7] ..... B60R 3/04; A46B 15/00; A47L 23/00

(52) U.S. Cl. ..... 15/161; 15/112; 280/164.2

(58) Field of Search ..... 15/161, 112, 215, 15/216, 217, 237, 238; 280/164.1, 164.2, 166

(56) References Cited

U.S. PATENT DOCUMENTS

| | | | | | |
|---|---|---|---|---|---|
| 1,196,453 | A | * | 8/1916 | Hatfield | 280/164.2 |
| 1,670,867 | A | * | 5/1928 | Paskal | 15/112 |
| 1,870,333 | A | * | 8/1932 | Kadavy | 15/237 |
| 1,946,578 | A | * | 2/1934 | Glauber et al. | 15/237 |
| 2,579,006 | A | * | 12/1951 | Mims | 15/237 |
| 2,818,594 | A | * | 1/1958 | Dawkins | 15/237 |
| 2,979,340 | A | * | 4/1961 | Morrissey | 280/164.2 |
| 5,970,561 | A | * | 10/1999 | Archibeque | 15/161 |
| 6,301,739 | B1 | * | 10/2001 | Cazaux | 15/161 |
| 6,363,567 | B1 | * | 4/2002 | Woodward | 15/161 |

FOREIGN PATENT DOCUMENTS

DE 1901836 * 8/1970

* cited by examiner

*Primary Examiner*—Gary K. Graham
(74) *Attorney, Agent, or Firm*—Edward L. Brown, Jr.

(57) ABSTRACT

The golf shoe brush of the present invention includes a housing, a shoe brush and a brush tray, which is slidably mounted to the housing. The housing is configured to be mounted under the body of a golf cart or motor powered vehicle. The brush tray is slidably mounted to the housing and is spring biased to move from a retracted position where the brush tray is substantially enclosed within the housing to an extended position where the brush tray is extended away from the housing to present the shoe brush for easy access by a golfer wishing to brush the sole of his or her golf shoe. The housing has a pin and the brush tray has openings for receiving and capturing the pin so that the brush tray can be secured in the retracted position.

6 Claims, 1 Drawing Sheet

GOLF SHOE BRUSH

This application claims benefit of U.S. provisional No. 60/390,959 filed Jun. 24, 2002.

FIELD OF THE INVENTION

This invention relates to a retractable golf shoe brush that can be mounted under the rear bumper of a golf cart.

BACKGROUND OF THE INVENTION

During a round of golf, golfers will often accumulate dirt and mud between the spikes of their golf shoes or within the cleats of their spikeless golf shoes. The accumulation of such dirt and mud on the golf shoes of a golfer can reduce the golfer's foot traction during a golf swing. This loss of traction can reduce the golfer's ability to control his or her golf swing. Golfers are particularly anxious to remove any condition that may interfere with the effectiveness of their golf shot making. Accordingly, there is a continuing need among golfers to remove accumulated mud and dirt from their golf shoes during a round of play.

SUMMARY OF THE INVENTION

Accordingly, it is an object of this invention to provide a golf shoe brush that can be mounted to a golf cart for use during a round of golf. It is another object of this invention to provide a golf shoe brush that is retractable so that it can be extended by a simple action of the golfer's foot and returned to a retracted position by a simple action of the golfer's foot.

These and other objects of the invention are attained in a golf shoe brush that includes a housing, a shoe brush and a brush tray for carrying the shoe brush, which is slidably mounted to the housing. The housing is configured to be mounted to a motorized golf cart under the rear bumper of the golf cart. The rear end of the housing is positioned underneath the golf cart while its forward end is located near the edge of the golf cart bumper. The brush tray carries the brush on its upper surface at its forward end. The brush tray is slidably mounted to the housing to move between a retracted position where the brush tray is substantially inside the housing and an extended position where the brush tray is extended away from the housing. The forward end of the brush tray can extend away from the golf cart while its rear end is enclosed within the housing. A spring connecting between the housing and the brush tray biases the brush tray in the extended position. Openings located toward the forward end of the brush tray receive a pin that is mounted toward the forward end of the housing. When the brush tray is in the retracted position, the openings in the brush tray receive and capture the pin at the forward end of the housing thereby locking the brush tray in a retracted position. The brush tray openings have horizontal portions that receive and capture the pin, as the brush tray is spring biased away from the retracted position.

The brush tray may be pushed into the retracted position by a downward pushing motion such as might be easily applied by the foot of a golfer. An upward and inward force on the forward end of the retracted brush tray such as might be easily applied by a short kicking motion of a foot causes the openings or slots in the brush tray to disengage the pin at the forward end of the housing. This action allows the brush tray and shoe brush to slide out into the extended position as the spring connecting the brush tray and the housing pulls the brush tray into the extended position.

DESCRIPTION OF THE DRAWINGS

The invention and its many attendant objects and advantages will become better understood upon reading the following description of the preferred embodiment in conjunction with the following drawings, wherein.

DETAILED DESCRIPTION OF THE PREFERRED EMBODIMENT

Figure 1:
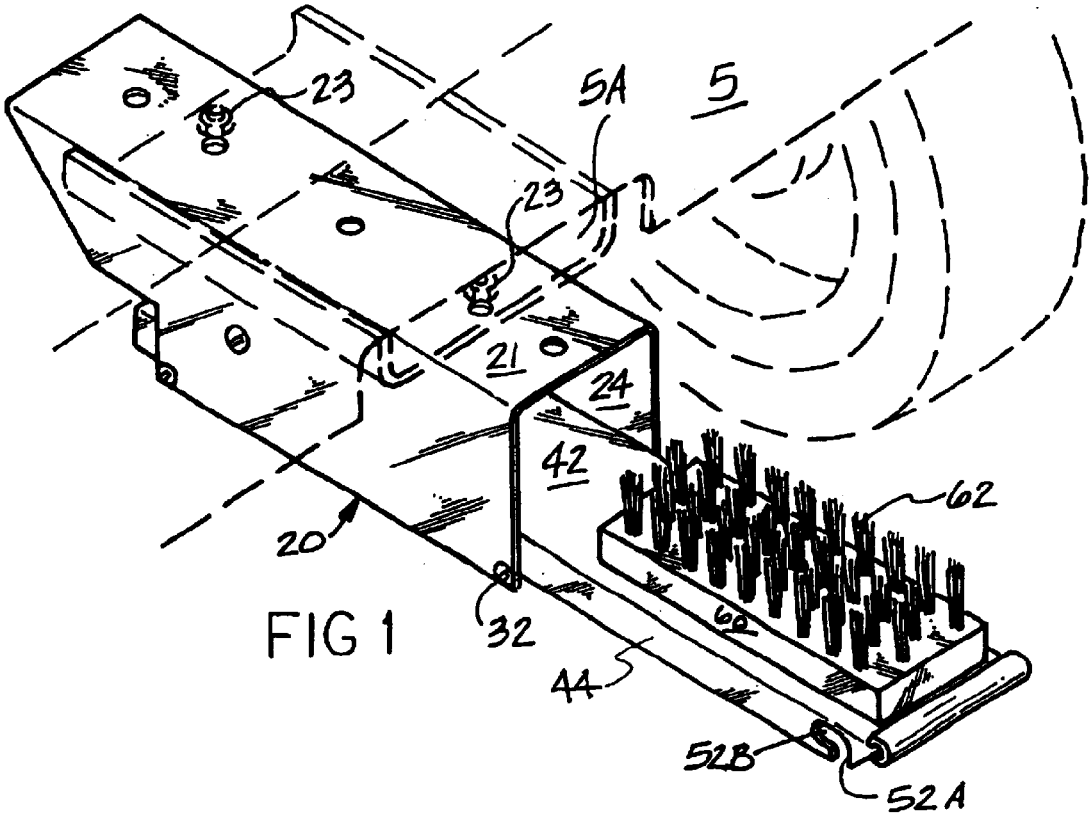
FIG. 1 is a perspective view of the golf shoe brush mounted under the rear bumper of a golf cart.

Turning now to the drawings, wherein like reference numerals identify identical or corresponding elements, and more particularly to FIG. 1 thereof, a golf shoe brush 10 is shown mounted under the rear bumper of golf cart 5 which could be mounted on other areas of the cart. Golf shoe brush 10 includes a housing 20, a brush tray 40 and a brush 60.

Figure 2:
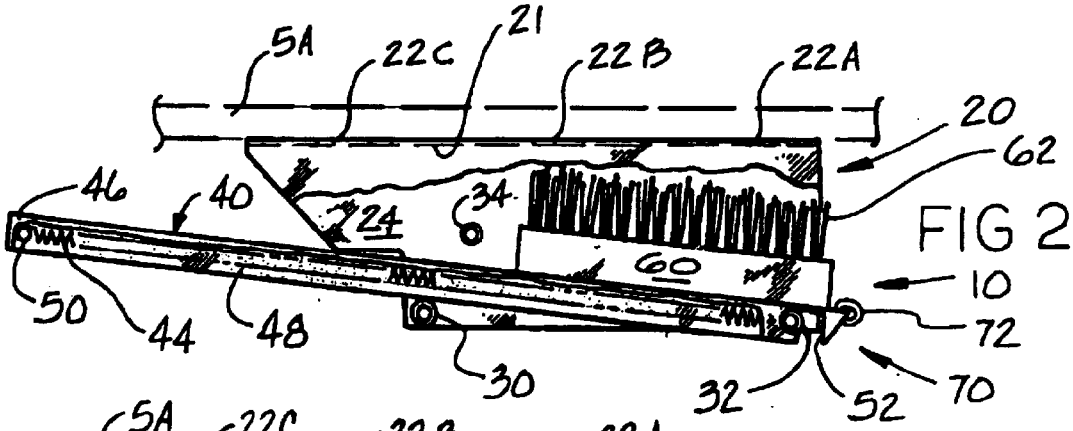
FIG. 2 is a partially cut away side view of the golf shoe brush shown in the retracted position; and, FIG. 3 is a partially cut away side view of the golf shoe brush shown in the extended position.
Figure 3:
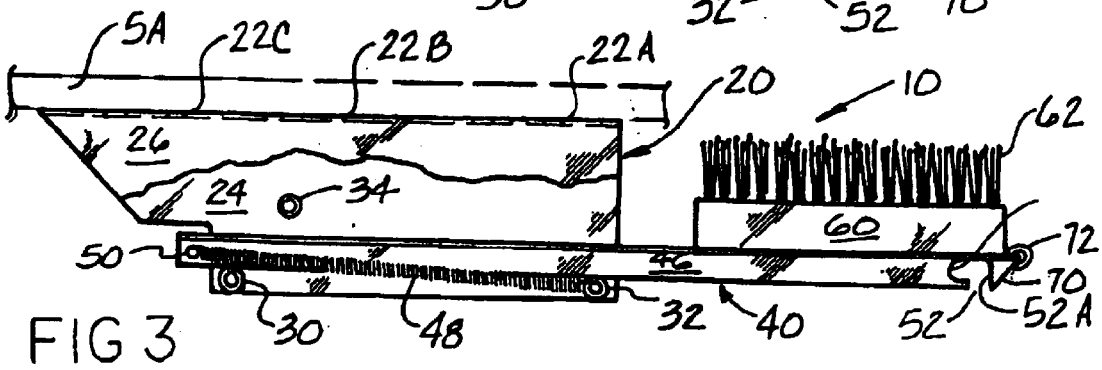

Housing 20 mounts golf shoe brush 10 to golf cart 5. Housing 20 also encloses and carries the retractable golf shoe brush 60 and tray that will be described in more detail below. As shown in greater detail in FIG. 2 and FIG. 3, housing 20 is a channel shaped member having a mounting web 21, a first flange 24 that is generally normal to web 21 and a second flange 26 that is generally parallel to first flange 26. Flanges 24 and 26 are also referred to as sidewalls 24 and 26. Web 21 includes a pattern of fastener holes 22A, 22B and 22C for receiving a fastener such as fastener 23 shown in FIG. 1. Golf cart 5 includes a pan 5A for receiving fasteners 23 that can be installed in fastener holes 22A, 22B and 22C. A first pin 30, a second pin 32 and a third pin 34, as seen in FIGS. 2 and 3, limit the vertical movement of tray 40. Generally, the function of first pin 30, second pin 32, and third pin 34 is to guide brush tray 40 as it slides within housing 20. Second pin 32 also anchors a spring 48, which will be described in greater detail below. First pin 30, second pin 32 and third pin 34 could be replaced by other equivalent features such as tabs extending from the flanges of housing 20. Housing 20 may be fabricated from sheet steel or sheet aluminum having a thickness between 0.050 and 0.10 inches. Housing could also be injection molded from a non-metallic material in a square tube.

Brush tray 40 is slidably mounted within housing 20 and is configured to slide between a retracted position as shown in FIG. 2 to an extended position where the front end 70 of brush tray 40 extends well past the end of housing 20 as shown in FIG. 3. Brush tray 40 is a channel shaped member having a web 42 and flanges 44 and 46 for carrying and supporting brush 60. Brush 60 is a heavy bristled brush that presents a pattern of bristles 62 suitable for cleaning the sole of a golf shoe. Brush 60 can be fastened to web 42 so that it can be removed and replaced.

As is also illustrated, brush tray 40 is spring biased with respect to housing 20 toward the extended position shown in FIG. 3 by a spring 48 which is connected at one end to pin 32 mounted to the end of housing 20 and at the other end to a transverse pin 50 which is mounted to the inner end of brush tray 40. Accordingly, spring 48 is stretched and applying a relatively large force tending to pull brush tray 40 towards the extended position when brush tray 40 is in the retracted position shown in FIG. 2. Conversely, spring 48 is relatively relaxed and is applying a relatively small force when brush tray 40 is in the extended position shown in FIG. 3.

Spring 48 is best configured if it has a spring constant of approximately 0.2 pounds per inch and so that it is extended approximately one to three inches when brush tray 40 is in the extended position shown in FIG. 3. With this preferred configuration, spring 48 will apply a force to brush tray 40 that is between 0.2 and 0.6 pounds when brush tray 40 is in the extended position shown in FIG. 3. Pin 50 is configured to extend past side flanges 44 and 46 of brush tray 40 by an amount sufficient to engage flanges 24 and 26 of housing 20. This interference of pin 50 with flanges 24 and 26 prevents brush tray 40 from extending past the position shown in FIG. 3. Pin 50 could also be replaced by tabs or other features that would provide an anchor for spring 48 and which also would engage flanges 24 and 26. Preferably, when brush tray 40 is in the retracted position shown in FIG. 2, spring 48 should be stretched between ten and thirteen inches so that it exerts a force upon brush tray 40 that is between 2.0 and 2.6 pounds.

As can be seen in FIGS. 1–3, two opposite, identical openings or latches 52 are disposed in flange 44 and flange 46 at the forward end of brush tray 40. Each of these openings includes a vertical slot 52A and a horizontal slot 52B. Vertical slot 52A is designed to receive pin 32 when brush tray 40 is slid over pin 32. As shown in FIG. 2, horizontal slot 52B receives and captures pin 32 as spring 48 pulls brush tray 40 toward the extended position. The body of brush tray 40, like housing 20, may be formed from similar materials.

Brush tray 40 may be pushed from the extended position shown in FIG. 3 to the retracted position shown in FIG. 2 by pushing the forward end of brush tray 40 until openings 52 receive pins 32. Inward pressure on brush tray 40 will allow horizontal slot 52B to release pin 32. Spring 48 pulls brush tray 40 slightly toward the extended position until horizontal slot 52B receives and captures pin 32. When horizontal slot 52B receives pin 32, brush tray 40 is locked in the retracted position of FIG. 2. Vibrations that cause vertical movements will not cause brush tray 40 to disengage from pin 32 because of horizontal slot 52B.

The steps for extending brush tray 40 as shown in FIG. 3, can be best understood with reference to FIG. 2. An inward and upward force in the direction indicated by arrow 70 on the end of tray 40, such as might be applied by a kicking movement of a foot to pad 72, will cause openings 52 of brush tray 40 to disengage and release pin 32. Brush tray 40 is free to slide out as spring 48 pulls it into the extended position shown in FIG. 3. When in this position, brush tray 40 presents brush 60 for use by a golfer. As brush tray 40 slides within housing 20 it is supported by pin 30 and pin 32. Tray 40 is constrained from rotating upward as it moves within housing 20 by pin 34, also mounted within housing 20.

It is to be understood that the brush assembly of the present invention may be manufactured in configurations other than those shown herein. For example, the housing and the brush tray could be cast parts of non-metallic materials such as nylon or other plastics; also the housing brush tray could have a box-shaped cross section. The pins limiting vertical movement of the brush tray could be full-length slots in the housing, which could be formed by various means. The latches in the brush tray could be of many different shapes or the latch could be located on the housing rather than the brush tray. Various other types of spring means which urge the brush tray into an extended position could be used other than the tension spring 48 disclosed. All of such modifications and variations are within the scope of the present invention and in view of the disclosure herein numerous other modifications or substitutions may be implemented by one skilled in the art.

What is claimed is:

1. A golf shoe brush for mounting on a golf cart comprising:

a housing having a longitudinal cavity defined by a pair of side walls;

a brush tray slidably-positioned within said cavity having front and rear ends;

a brush attached to the front end of said tray, the brush having an extended and a retracted position;

a biasing member connecting the brush tray to the housing urging the tray to the brush extended position;

at least two pin members mounted on said housing limiting the vertical movement within the housing of said tray;

a latch member on said tray having a horizontal slot opening into a vertical slot which releasably engages one of said pins for retaining said tray and a brush in the retracted position.

2. A golf shoe brush as set forth in claim 1 wherein the latch is located at the front of the tray and the latch is released by exerting a light force inward and upward on the front of the tray.

3. A golf shoe brush as set forth in claim 1 wherein the biasing member is a tension spring connecting the rear end of the brush tray to one of said pin members located approximately at the front of said housing.

4. A golf shoe brush for mounting on a golf cart or other motorized vehicle comprising:

a housing having longitudinal cavity defined by a top and bottom and a pair of side walls;

a brush tray slidably-positioned within said cavity having front and rear ends;

a brush attached to the front of said tray;

a biasing member connecting the brush tray to the housing urging the tray to a brush extended position;

at least two pin members mounted on the housing limiting the vertical movement within the housing of the tray; and, a latch member on said tray having a horizontal slot opening into a vertical slot which releasably engages one of said pins for retaining said tray mounted brush in a retracted position.

5. A golf shoe brush as set forth in claim 4 wherein the latch is located at the front of the tray and the latch is released by exerting a light force inward and upward on the front of the tray.

6. A golf shoe brush as set forth in claim 4 wherein the biasing member is a tension spring connecting the rear end of the brush tray to one of said pin members located approximately at the front of said housing.

* * * * *